United States Patent [19]

Gruber

[11] 4,112,694

[45] Sep. 12, 1978

[54] TUNNEL-LAGGING ELEMENT AND SYSTEM

[75] Inventor: Rudolf Gruber, Millstatt am See, Austria

[73] Assignee: GD Anker Gebirgs-Dübel-Anker GmbH & Co. KG, Millstatt am See, Austria

[21] Appl. No.: 794,317

[22] Filed: May 5, 1977

[30] Foreign Application Priority Data

May 7, 1976 [AT] Austria ..... 3362/76

[51] Int. Cl.[2] ..... E21D 11/14; E21D 11/18

[52] U.S. Cl. ..... 405/150; 52/640; 52/653

[58] Field of Search ..... 61/45 R, 42, 45 C, 84; 52/652, 653, 654, 726, 646, 648, 639, 640, 650

[56] References Cited

U.S. PATENT DOCUMENTS

| | | | |
|---|---|---|---|
| 1,105,776 | 8/1914 | Haskell | 52/653 |
| 1,485,811 | 3/1924 | Pederson | 52/653 |
| 1,659,035 | 2/1928 | Lovell | 52/652 X |
| 2,179,554 | 11/1939 | Hadley | 52/653 X |
| 3,126,708 | 3/1964 | Jasper | 61/45 R |
| 3,381,479 | 5/1968 | Curzio | 61/45 R |
| 3,462,959 | 8/1969 | Mallander | 61/45 R |

FOREIGN PATENT DOCUMENTS

| | | | |
|---|---|---|---|
| 56,681 | 12/1921 | Sweden | 52/653 |

*Primary Examiner*—Dennis L. Taylor
*Attorney, Agent, or Firm*—Karl F. Ross

[57] ABSTRACT

A tunnel-lagging element, adapted to be embedded in spray or injection concrete for the lining of the wall of a tunnel, comprising a pair of reinforcing bars which are held substantially against the tunnel wall, and a further pair of such bars spaced from the bars of the first pair. The bars at the central third of their lengths are fixed to one another against relative movement by straps while, toward the ends of the element, the bars of the two pairs are held together with limited freedom of longitudinal movement. The entire assembly of bars and straps can be embedded in the concrete lining.

8 Claims, 5 Drawing Figures

TUNNEL-LAGGING ELEMENT AND SYSTEM

FIELD OF THE INVENTION

The present invention relates to a tunnel-lagging element and, more particularly, to a tunnel-support system using spray or injection concrete as a lining material and reinforcing structures lying substantially against the tunnel wall.

BACKGROUND OF THE INVENTION

For the purpose of this description, a "tunnel-lagging element" will be understood to be a structure adapted to be embedded in the concrete lining and forming a stay or support.

It is known in the building of tunnels in accordance with modern techniques, hereinafter referred to as the "Austrian technique," to provide tunnel-lagging elements as U-shaped steel arches which are embedded in injection or spray concrete applied to the tunnel wall as a lining and structurally different material.

These heavy steel arches, which can have a weight per running meter of 21 to, for example, 27 kgs are already in use and must be bent to the desired wall contour of the tunnel. They are customarily supplied in piece lengths of 3 to 4 meters, i.e. as arch segments, and are connected together by fishplates or the like.

The resulting arches, assembled from these rigid segments, are themselves relatively stiff and have a cross section dimensioned to accept the theoretical maximum or bursting pressure, depending upon the direction of the expected stress and customarily are over dimensioned to be able to withstand several times the expected bursting forces.

As a practical matter, the arches cannot be spaced the desired 10 to 20 cm from the surface of the wall of the tunnel as is preferred to enable them to withstand the nominal bursting force, but may lie some 50 to 100 cm therefrom, with the space between the arch and the wall being filled with spray or injection concrete. Hence the concreting of the arch and the wall is a time-consuming and expensive proposition, especially since large gaps must be filled between the surface of the tunnel wall and the stay or lagging element. The concreted structure is generally relatively rigid and, as a rigid structure, must be capable of withstanding the static and dynamic stresses which may result from earth movements, settling and the like. Here again the tunnel lining and the arches must be of sufficient cross section to provide the support forces.

It has already been proposed to provide a thin reinforced spray or injection concrete shell along the tunnel wall as a so-called semistiff tunnel lining. Such linings can permit controlled movements of the tunnel wall without disruption of the shell until the entire system stabilizes. In this case, the reinforcements may be bars embedded in the concrete. The stiff arches mentioned previously are generally unsuitable for this approach to tunnel-wall lining.

OBJECTS OF THE INVENTION

It is the principal object of the present invention to provide a tunnel-lagging element particularly suitable for use in the modern Austrian technique of tunnel construction and providing flexibility, improved bonding to the concrete lining material, versatility and low cost.

Another object of the invention is to provide an improved tunnel-lagging element and/or tunnel-wall structure which obviates the disadvantages of conventional rigid and heavy tunnel arches which do not bond effectively to the concrete.

It is still another object of the invention to provide a tunnel-lagging element and system which can be readily adapted to the cross section or section modulus required for various approaches.

SUMMARY OF THE INVENTION

These objects and others which will become apparent hereinafter are attained, in accordance with the present invention, in a tunnel-lagging element which comprises at least two reinforcing bars held in spaced apart parallel relationship without longitudinal shiftability by transverse connectors or straps constituting therewith a ladder-like configuration (first pair of reinforcing bars) these bars lying proximal to the tunnel wall. In addition, at least two further reinforcing bars are provided for each element (second pair of bars relatively distal from the wall) and in mutually parallel spaced apart relationship and are spaced away from the bars of the first pair, being connected therewith by the aforementioned straps which fix the bars of the two pairs against relative longitudinal movement in the region of the middle third of the length of the resulting element, but permit relative longitudinal displacement of the bars of the two pairs towards the end of the element. The result is a three-dimensional structure which can be wholly embedded in the concrete mass used to line the tunnel.

The individual reinforcing arches, each constituted of a plurality of such tunnel-lagging elements connected substantially in end-to-end relationship so that each tunnel-lagging element constitutes an arch segment, lie along the wall of the tunnel and can conform closely to this wall as will be apparent hereinafter.

The basket-like tunnel-lagging elements which are so assembled can be prefabricated and shaped to conform to the wall of the tunnel in situ. The reinforcing bars can be conventional reinforcing bars provided with deformations, lugs and the like in a helical pattern and can be composed of any conventional steel used for this purpose. Advantageously the reinforcing bars are composed of steel (Torstahl) provided with helical ribs extending continuously the full length thereof. The four steel bars of each lagging element are fixed against longitudinal movement in the center of the lagging element but the bars of the two pairs are free to move longitudinally relative to each other toward the ends of the elements. This permits the tunnel-lagging element to be shaped to the desired arch configuration in conformity with the shape of the tunnel wall, i.e. to be bent further in place. In all other directions, the tunnel-lagging element is statically stiff.

To facilitate the bending operation which ultimately conforms the tunnel-lagging element of the present invention to the contours of the tunnel wall, the reinforcing rods of the element can be given a slight bend or curvature before the element is introduced into the tunnel, i.e. in the course of manufacture. This slight curvature provides the orientation and direction of bend for the final bending operation.

The fixed connection of the reinforcing rods of the element at the central portion thereof can be effected by welding them to spacers or to a connecting member adapted to hold all four rods in their spaced-apart relation.

According to an important feature of the invention, the connecting member comprises a substantially rectangular frame, open at one side, composed of sheet iron or steel and consisting essentially of a pair of shanks lying at right angles to a bight. At the corner between the shanks and the bight, the proximal reinforcing rods are lodged, preferably by a clamp which can comprise another sheet iron member drawn against the bight by a bolt. The free ends of the shanks may be formed with inwardly turned or outwardly turned eyes or openings receiving the respective distal reinforcing bars. When the connecting members are disposed in the central region of the tunnel-lagging element, the distal reinforcing bars can be welded to the corresponding eyes or held against longitudinal displacement by clamping the eyes tightly against these bars. Remote from the central connecting members, the connecting members which retain the distal reinforcing bars with the same freedom of longitudinal movement can have eyes which pass the distal reinforcing bars with clearance.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 5:
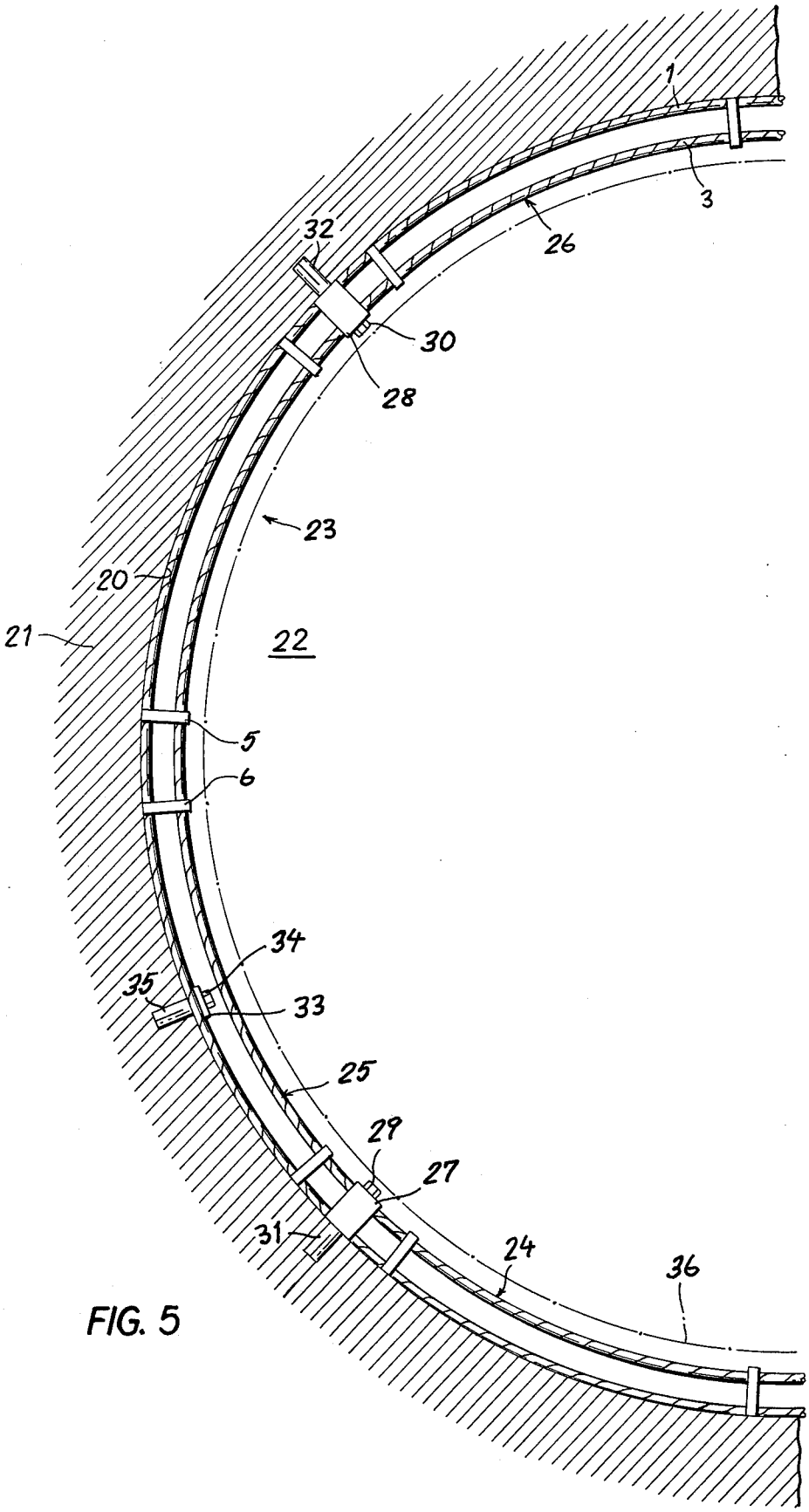
FIG. 5 shows, in transverse section through a portion of a tunnel, the use of the tunnel-lagging element of the present invention.

Referring first to FIG. 5, it can be seen that a wall 20 cut into a subsurface stratum 21 to form a tunnel 22 can be provided with an arch structure 23 consisting of a plurality of tunnel-lagging elements 24, 25 and 26 which are connected at their ends by straps here represented at 27 and 28 but shown in detail in FIGS, 3 and 4. Each of the straps 27, 28 has a bolt 29, 30 which engages an expansion anchor 31, 32 lodged in a bore of the tunnel wall. It will be apparent that, after a slight curvative imparted to the tunnel-lagging element during its fabrication, the latter can be drawn against the tunnel wall by plates, e.g. as shown at 33 via bolts 34 and expansion anchors 35 to conform to the curvature of this wall. Once the arch structure is in place, a concrete lining of the injection or spray concrete or Gunite is applied as shown by the dot-dash line 36 to line the tunnel wall and fully embed the tunnel-lagging element, the latter forming reinforcement for the tunnel lining material and providing with this material a somewhat yieldable support structure of the type described previously.

Each of the tunnel-lagging elements is comprised of four slightly bent steel reinforcing rods 1, 2, 3, 4 formed with helical deformations or ribs and preferably composed of conventional reinforcing-rod steel stock (Torstahl). The rods 1 - 4 forming a ladder-like structure with a plurality of connecting members 5, 6, 7, 8 which are longitudinally spaced along the tunnel-lagging element and are composed of sheet iron or sheet steel. Each of the connecting members 5 - 8, as can be seen from FIG. 2, has a frame configuration open at one side and thus the configuration of a U, with a bight and a pair of arms or shanks. The clamping bar 9 can be drawn against the bight by a screw 10 to press the proximal bars 1, 2 into the corners between each shank and the bight. As a result, the connecting members 5 - 8 are held against longitudinal movement upon the proximal bars 1, 2, which substantially rest against the wall of the tunnel. This clamping arrangement also fixes the two bars 1, 2 against relative longitudinal movement.

The connecting members 5 - 8 are also formed, at the free ends of their shanks with eyes 13 and 14 by inwardly turning or outwardly turning these free ends, the eyes receiving the distal rods 3 and 4. The connecting members 5 and 6 disposed along the central third of the length of the tunnel-lagging element can have their eyes 11 and 12 hydraulically pressed against the rods 3, 4 and welded thereto so that the rods are longitudinally fixed to these connecting members 5 and 6.

However, the eyes 13 and 14 of the connecting members 7 and 8 toward the ends of the tunnel-lagging element receive the rods 3 and 4 with play to permit relative longitudinal movement of these ends of the distal rods and the corresponding connecting members 7 and 8. This permits relative longitudinal displacement of the proximal and distal pairs of rods when the reinforcing element is bent to its arch shape as described.

The final shape of the arch to correspond to the tunnel cross section is effected in situ. The slight curvature of the prefabricated reinforcing elements facilitates the subsequent shaping of the element to the final form in the tunnel and establishes the bending direction.

While clamping of the reinforcing rods 1 and 2 to the members 5 - 8 is preferred, it should be noted that a welded connection is also possible within the scope of the present invention.

Figure 1:
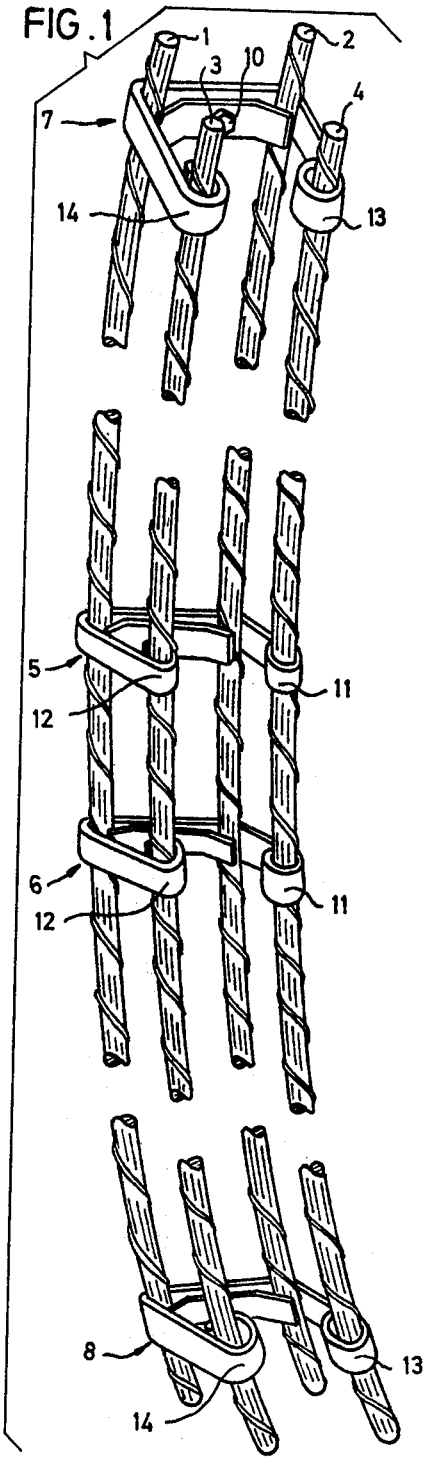
FIG. 1 is a somewhat diagrammatic perspective view, partly broken away, of a tunnel-lagging element according to the pressent invention.
Figure 2:
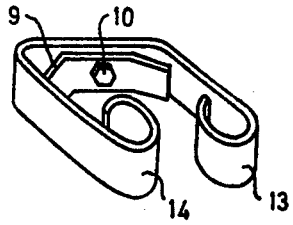
FIG. 2 is a perspective view of a connecting member as used in the tunnel-lagging element of FIG. 1.

The basic configuration of the connecting members 5 - 8 used in the structure of FIG. 1 can be seen from FIG. 2 to be generally rectangular. The ends of the clamping bar 9 are inclined to press the reinforcing bars 1 and 2 into the corners as this bar 9 is drawn toward the bight.

The erection of a reinforcing structure in the tunnel is effected initially with the use of short self-spreading expansion anchors with the aid of which the tunnel-lagging element is pressed against the wall of the tunnel. Thereafter, the final mounting can be effected by introducing long systematic offset rock anchors with large anchor plates through the tunnel-lagging elements. These latter anchors have not been illustrated.

One of the advantages of the tunnel-lagging element described hereinabove over prior elements is that the closer approach of the tunnel-lagging element to the wall of the tunnel permits the anchors to reach more deeply into the tunnel wall and be more firmly held therein.

Figure 3:
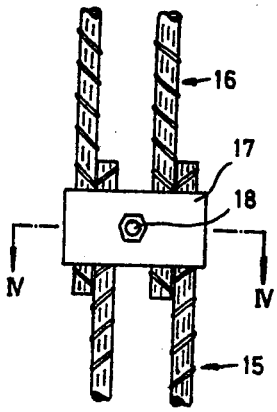
FIG. 3 is an elevational view showing the strap connecting the ends of two such elements.
Figure 4:
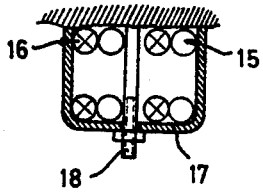
FIG. 4 is a cross-sectional view taken generally along the lines IV — IV of FIG. 3.

A complex reinforcing arch is formed, as has been diagrammatically illustrated in FIG. 5, from a plurality of tunnel-lagging elements of the type described in connection with FIG. 1. Preferably the ends of the successive tunnel-lagging elements of a given arch are overlapped (see FIG. 3) and are clamped together and against the wall of the tunnel by a U-shaped anchor plate or strap 17 which embraces all eight overlapping ends of the reinforcing bars of the two tunnel-lagging elements. In FIG. 3, the two tunnel-lagging elements have been represented generally at 15 and 16. The strap 17 is held against the tunnel wall by a bolt-type anchor 18 previously fixed, e.g. by a spreading anchor, in the tunnel wall. After assembly of the tunnel-lagging elements of the arch, the anchor regions, the space between the rods, the straps and the connecting members are all embedded in the injection concrete which is applied to line the tunnel wall.

Each reinforcing or tunnel-lagging element can be provided with more than four rods, if desired, and, depending upon the strength of the reinforcing or tunnel-lagging element desired, one or more additional rods can be provided adjacent each of the rods 1, 2, 3 or 4. In addition, a second assembly of rods 1 – 4 may be provided adjacent the assembly illustrated in FIG. 1 in the longitudinal direction of the tunnel and can be connected thereto with additional members such as that shown at FIG. 2. Finally, additional rods can be connected to the bars 3 and 4 by similar connecting members so that the tunnel-lagging element is increased in size with additional rods toward the center of the tunnel.

All of these modifications are deemed to be included within the ambience of the invention except as the scope may be limited by the appended claims.

I claim:

1. A tunnel-lagging element for embedding in a concrete tunnel lining, comprises:

a first pair of mutually parallel transversely spaced curved rods adapted to lie relatively proximal to a tunnel wall;

a second pair of transversely spaced mutually parallel curved rods spaced from said first pair of rods and relatively distal from said wall;

first means at the central third of the length of the elements for securing all of said rods in spaced-apart relation without relative freedom of longitudinal movement; and respective second means toward each end of the element for retaining said rods in spaced-apart relation while permitting longitudinal displacement of said first pair of rods relative to said second pair of rods each of said second means securing the rods of said first pair against longitudinal displacement relative to one another.

2. The tunnel-lagging element defined in claim 1 wherein said element has a slight curvature upon fabrication and is thereafter bent in situ to conform to the tunnel wall.

3. The tunnel-lagging element defined in claim 1 wherein each of said first and second means includes a sheet iron frame open at one side and receiving said rods of said first pair at corners of the frame.

4. The tunnel-lagging element defined in claim 3, further comprising a clamping bar for pressing the rods of said first pair into said corners and a screw for tightening said clamping bar against said frame.

5. The tunnel-lagging element defined in claim 4 wherein said frame has a pair of shanks each formed at a free end with a respective eye receiving a respective rod of said second pair.

6. The tunnel-lagging element defined in claim 5 wherein the rods of said second pair are fixed in the respective eyes of the frames of said first means, the eyes of the frames of said second means receiving the pairs of said second pair with freedom of longitudinal movement.

7. The tunnel-lagging element defined in claim 6 wherein a second tunnel-lagging element is disposed with an end overlapping an end of the first-mentioned tunnel-lagging element, further comprising a U-shaped strap engaging the overlapping ends and retaining same against the wall of the tunnel.

8. A method of lining a tunnel comprising the steps of:

prefabricating a tunnel-lagging element with a first pair of mutually parallel transversely spaced curved rods adapted to lie relatively proximal to a tunnel wall;

a second pair of transversely spaced mutually parallel curved rods spaced from said first pair of rods and relatively distal from said wall;

first means at the central third of the length of the elements for securing all of said rods in spaced-apart relation without relative freedom of longitudinal movement; and respective second means toward each end of the element for retaining said rods in spaced-apart relation while permitting longitudinal displacement of said first pair of rods relative to said second pair of rods, each of said second means securing the rods of said first pair against longitudinal displacement relative to one another;

pressing said tunnel-lagging element against a tunnel wall and thereby bending said tunnel-lagging element to a final curvature;

repeating the preceding step with at least one further tunnel-lagging element disposed in overlapping relation to the first-mentioned tunnel-lagging element at respective ends of the two elements;

clamping the overlapping ends of the two elements against said wall; and lining said wall with concrete while embedding said elements therein.

* * * * *